US006611112B2

(12) United States Patent
Raiser et al.

(10) Patent No.: US 6,611,112 B2
(45) Date of Patent: Aug. 26, 2003

(54) APPLIANCE FOR DISCHARGE LAMPS WITH RELIABLE STARTING

(75) Inventors: Franz Raiser, München (DE); Bernhard Reiter, München (DE)

(73) Assignee: Patent Treuhand Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 10/119,847

(22) Filed: Apr. 11, 2002

(65) Prior Publication Data

US 2002/0180376 A1 Dec. 5, 2002

(30) Foreign Application Priority Data

May 18, 2001 (DE) ..... 101 24 636

(51) Int. Cl.[7] ..... H05B 41/00

(52) U.S. Cl. ..... 315/291; 315/224; 315/209 R; 315/307; 315/DIG. 7

(58) Field of Search ..... 315/224, 209 R, 315/209 T, 291, 307, DIG. 7, DIG. 5

(56) References Cited

U.S. PATENT DOCUMENTS 5,187,414 A * 2/1993 Fellows et al. ..... 315/307
5,488,269 A * 1/1996 El-Hamamsy et al. .. 315/209 R
5,723,953 A * 3/1998 Nerone et al. ..... 315/DIG. 7
6,140,779 A * 10/2000 Kanazawa et al. ..... 315/291
6,172,468 B1 * 1/2001 Hollander ..... 315/307
6,188,179 B1 * 2/2001 Boys et al. ..... 315/244
6,369,526 B1 * 4/2002 Pogadaev et al. ..... 315/224

FOREIGN PATENT DOCUMENTS

EP 0351012 1/1990
EP 0831678 3/1998

* cited by examiner

*Primary Examiner*—Don Wong
*Assistant Examiner*—Ephrem Alemu

(57) ABSTRACT

Appliance for discharge lamps, which has a load circuit with a resonance point at a resonant frequency fres. In order to start the discharge lamps, the load circuit is fed with a square-wave source voltage Uq, whose period duration Tper multiplied by the resonant frequency fres of the load circuit produces approximately a natural number n which is greater than 1. The pulse duration Tpulse at the source voltage Uq is in a range which is described by the following condition:

$$\frac{0.3}{fres} \leq Tpulse \leq \frac{1}{fres}$$

6 Claims, 2 Drawing Sheets

APPLIANCE FOR DISCHARGE LAMPS WITH RELIABLE STARTING

TECHNICAL FIELD

The invention is based on an appliance for discharge lamps as claimed in the precharacterizing clause of claim 1. In particular, the invention relates to the starting of these lamps.

BACKGROUND ART

Appliances for discharge lamps, referred to as lamps for short in the following text, have, according to the prior art, an AC voltage generator which is connected via a load circuit to one or more lamps. The AC voltage generator is normally in the form of a half-bridge or full-bridge inverter with electronic switches, so that the AC voltage generator emits a square-wave source voltage Uq. The load circuit is essentially a reactance network, whose object, inter alia, is to transform the source impedance of the AC voltage generator to a value required for operation of lamps.

Particularly for operation of low-pressure lamps, the load circuit also carries out the function of starting these lamps. To this end, the load circuit is designed such that it has a resonance point. This means that the load circuit is able to produce a high voltage, which is suitable for starting a lamp, at the output when excited at its resonant frequency fres. In the simplest case, the load circuit comprises an inductance L and a capacitance C connected in series. This circuit has a resonant frequency fres at $\frac{1}{2}\pi\sqrt{LC}$. A lamp is connected in parallel with the capacitance C. If the AC voltage generator feeds a square-wave source voltage Uq at a fundamental frequency corresponding to the resonant frequency fres into the load circuit, then this results in a voltage increase across the capacitance C, which leads to the lamp being started. Accordingly, the prior art strives to satisfy the following condition Tper·fres =1 for the period duration Tper of the source voltage Uq. The desired value for the duty ratio of the source voltage Uq is 0.5. The duty ratio is the ratio of the pulse duration Tpulse to the pulse pause in the square-wave source voltage Uq.

One problem when starting lamps in the way described above is that the fundamental frequency of the source voltage Uq which is emitted from the AC voltage generator must be set accurately, since the resonance point of the load circuit in general has a narrow bandwidth. The resonant frequency fres must be produced with an accuracy of better than 1% since, otherwise, the voltage across the capacitance C will not be increased sufficiently for the lamp to be started reliably. If the resonance point of the load circuit has a high Q-factor, then it is also possible for a problem to occur due to the resonant frequency fres being produced too accurately. In this case, current and voltage amplitudes which lead to destruction of components can occur in the appliance.

So-called self-excited generators are known for use as the AC voltage generator. In these generators, the drive signal for the electronic switches in the AC voltage generator is obtained from the load current. This results in a self-regulating effect, which places the frequency of the source voltage Uq, which is emitted by the AC voltage generator, in the vicinity of the resonant frequency fres. However, such self-excited generators can be used to only a limited extent to control lamp operation, for which reason so-called externally excited generators are used increasingly more frequently. In externally-excited generators, an independent oscillator produces the drive signal for the electronic switches in the AC voltage generator. Independent means that, in contrast to self-excited generators, an oscillation can be produced which is independent of variables such as the load current or load voltage.

In the prior art, a number of solutions have been proposed with the aim of setting the frequency of an independent oscillator, as mentioned above, such that the lamp is started reliably.

The document EP 0 351 012 (Wong) proposes that the frequency of the independent oscillator be set to a value which is above the resonant frequency fres, and that it is then reduced continuously until it reaches the resonant frequency fres. However, this results in the problem that, firstly, the change in the frequency of the independent oscillator may not be too fast to allow the resonance to build up in the load circuit while, on the other hand, the lamp should be started as quickly as possible in order that preheated filaments in a lamp do not cool down again before starting.

The document EP 0 831 678 (Nerone) proposes that a closed control loop be used to control the frequency of the independent oscillator such that the desired starting voltage is produced across the lamp. Since, as already mentioned, the resonance point of the load circuit has a narrow bandwidth, the proposed control system is highly complex.

A further problem is that the independent oscillator ever more frequently makes use of digital technology. This may be done by using a microcontroller. Digital technology means that the independent oscillator can no longer produce any desired frequency. Only discrete frequencies can be produced, and these are predetermined by a fixed interval. In order to produce the resonant frequency fres with sufficient accuracy, a high level of complexity must be accepted in order that the predetermined interval allows sufficiently good resolution for the frequencies which can be produced.

DISCLOSURE OF THE INVENTION

One object of the present invention is to provide an appliance as claimed in the precharacterizing clause of claim 1, which allows reliable starting of discharge lamps, with little complexity.

This object is achieved for an appliance having the features of the precharacterizing clause of claim 1 by the features in the characterizing part of claim 1. Particularly advantageous refinements can be found in the dependent claims.

As stated above, an AC voltage generator for starting lamps produces a square-wave source voltage Uq whose fundamental frequency is close to the resonant frequency fres. According to the prior art, this source voltage Uq, once it has been set, is applied continuously throughout the entire starting process. When this source voltage Uq is switched on, a transient oscillation process is evident, which forms a transient overvoltage across the lamp. Although the amplitude of this overvoltage is sufficient to start the lamp, it is too short to actually start it. The present invention makes use of the transient overvoltage by triggering transient oscillation processes in a periodic sequence according to the invention. To this, the AC voltage generator produces a square-wave source voltage Uq whose period duration Tper attempts, according to the invention, to satisfy the following condition: Tper·fres=n where n is a natural number greater than 1. In order to achieve a sufficiently high voltage to start the lamp, the following condition: $0.3 \leqq \text{Tpulse}\cdot\text{fres} \leqq 1$ must be satisfied according to the invention, for the pulse duration Tpulse of the source voltage Uq.

The profile of the source voltage Uq according to the invention has the advantage that this reduces the accuracy requirement for the independent oscillator by a factor of at least two. This means that the condition Tper·fres=n according to the invention mentioned above need be satisfied only approximately. In this context, approximately means that the condition is satisfied with an accuracy of 3%. Even less accuracy is sufficient for higher values of n.

The profile of the source voltage Uq according to the invention has the further advantage that the capability to select Tper and Tpulse makes it possible to adjust the amount of energy which the AC voltage generator feeds into the load circuit. It is thus possible to prevent components from being damaged if the load circuit is excited at precisely its resonant frequency.

For high values of n, the described transient oscillation process is triggered only rarely. This means that the lamp may no longer be started reliably. It has been found that a value of n=3 ensures that the lamp starts reliably.

The profile of the source voltage Uq according to the invention is preferably fed into a load circuit which contains an inductance and a capacitance connected in series. This results in the minimum complexity to achieve the desired resonance.

The profile of the source voltage Uq according to the invention is preferably produced by an independent oscillator since, as explained above, this makes it simple to influence the profile of the source voltage Uq.

It is particularly advantageous for the independent oscillator to use digital technology. This allows the profile of the source voltage Uq to be modified just by changing register contents. This can be done just by a software change, if a microcontroller is used.

The complexity to provide the AC voltage generator according to the invention is then very low, provided the electronic switches contained in it can be driven directly from the independent oscillator.

BRIEF DESCRIPTION OF THE DRAWINGS

The invention will be explained in more detail in the following text with reference to an exemplary embodiment. In the drawings.

BEST MODE FOR CARRYING OUT THE INVENTION

Figure 1:
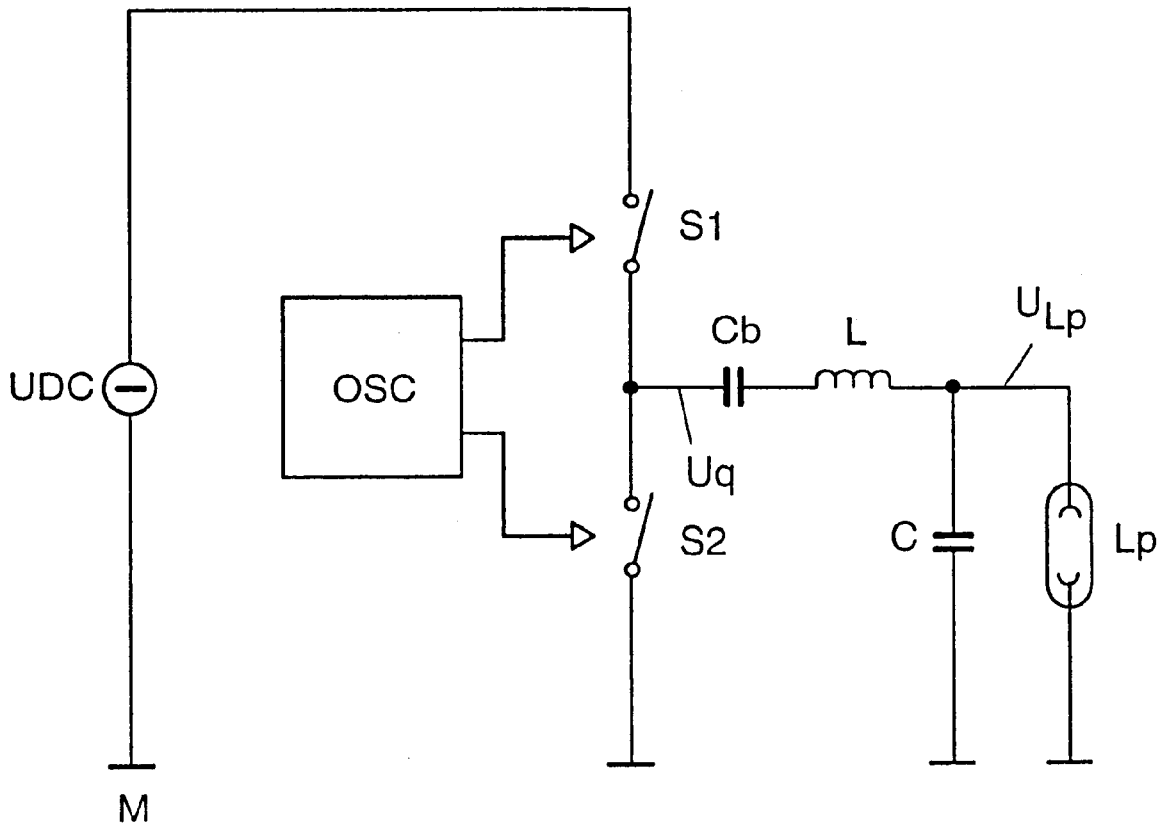
FIG. 1 shows a circuit diagram of an appliance according to the invention

FIG. 1 shows a block diagram of an appliance according to the invention. The AC voltage generator is in the form of a half-bridge inverter comprising the electronic switches S1 and S2, which are driven by an independent oscillator OSC, connected in series. The series circuit formed by the electronic switches S1 and S2 is connected to a DC voltage source UDC in order to supply it with power. The reference potential is the potential M, which is connected to one connection of the DC voltage source UDC. The output of the AC voltage generator, where the source voltage Uq is produced, is connected to the junction point of the electronic switches S1 and S2. The load circuit is connected between the source voltage Uq and the reference potential M. This comprises a coupling capacitor Cb, an inductance L and a capacitor C connected in series. The coupling capacitor Cb is used for decoupling the DC component of the source voltage Uq. The inductance L and the capacitance C form a series resonance point at the resonant frequency fres. The output of the load circuit, to which a lamp Lp is connected, is connected in parallel with the capacitance C, where a lamp voltage ULp is also tapped off.

Figure 2:
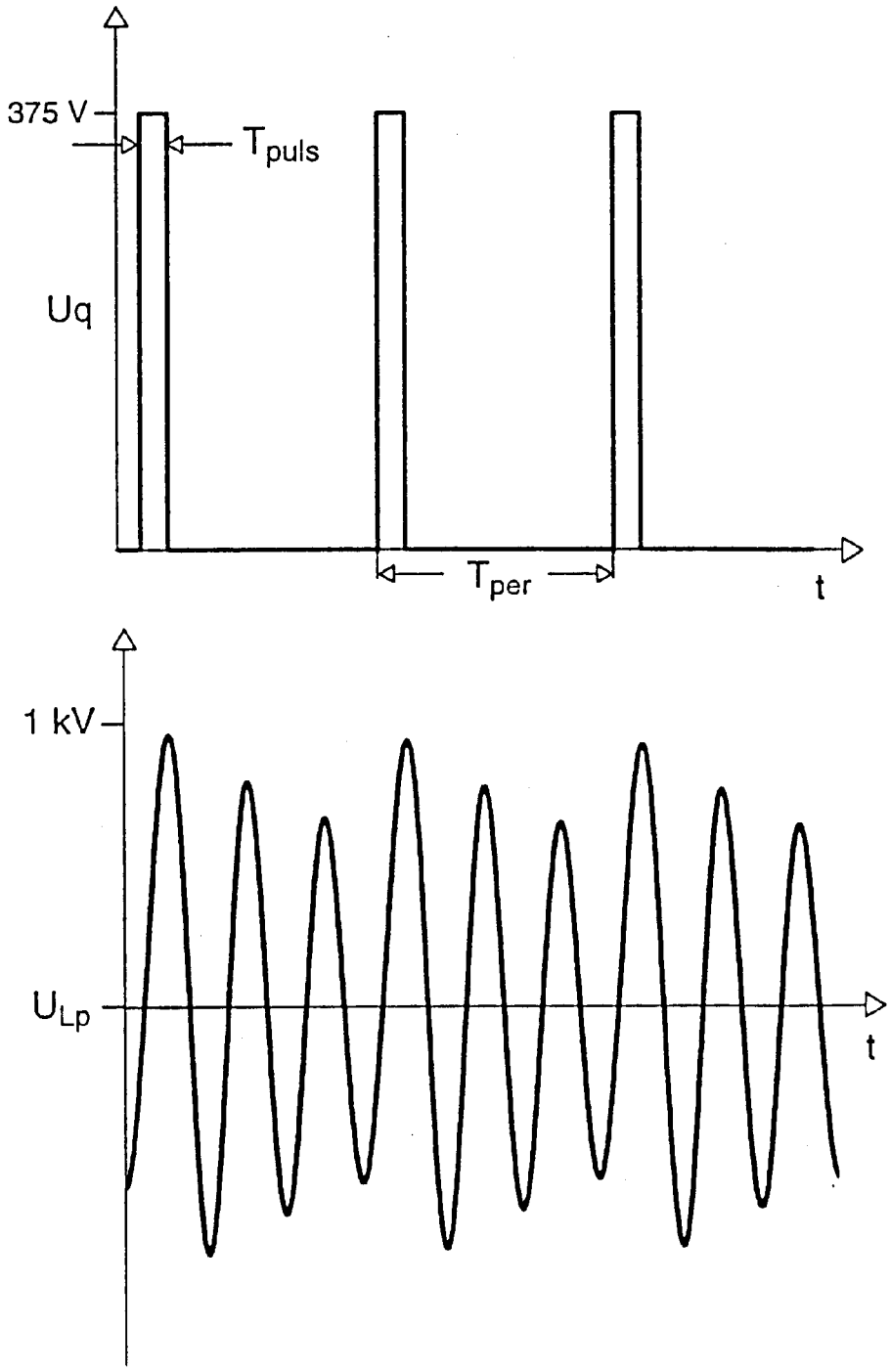
FIG. 2 shows voltage profiles, according to the invention, of an appliance as shown in FIG. 1

FIG. 2 shows the time profile, according to the invention, of the source voltage Uq and of the lamp voltage ULp while the lamp Lp is being started. The source voltage Uq has a square-wave profile with a period duration Tper and a pulse duration Tpulse. The amplitude is 375 V, which corresponds to the value of the voltage supplied by the DC voltage source UDC. The voltage ULp has a sinusoidal profile, whose frequency corresponds to the resonant frequency fres. The increase in voltage which occurs for each pulse of the source voltage Uq can clearly be seen. The peak voltage of the lamp voltage ULp is approximately 1000 V, and is suitable for starting a low-pressure discharge lamp. Tuned circuits with a higher Q-factor can be used to produce a higher voltage, which may be suitable for starting high-pressure discharge lamps.

In appliances for low-pressure discharge lamps, typical values are 2 mH for the inductance L, and 10 nF for the capacitance C. These values are based on the voltage profiles in FIG. 2, and result in a calculated resonant frequency fres of 35.5 kHz. In the illustrated example, the period duration Tper is 87 $\mu$s.

The product of the period duration Tper and the resonant frequency fres is thus 3.08. This result is equivalent to the natural number 3, within an accuracy of 3%. In the illustrated example, the pulse duration Tpulse is 10.7 $\mu$s. This value is in the required range between 0.3/fres (8.4 $\mu$s in the example) and 1/fres (28 $\mu$s in the example).

What is claimed is:

1. An appliance for discharge lamps (Lp) having the following features:

a load circuit which has an input which is connected to an AC voltage generator, which emits a square-wave source voltage Uq with a period duration Tper and a pulse duration Tpulse, the load circuit has an output, which can be connected to discharge lamps (Lp), the load circuit has a resonance point at a resonant frequency fres, which means that the voltage at the output (ULp) may be greater than the voltage at the input (Uq), characterized in that in order to start discharge lamps (Lp), the AC voltage generator emits a source voltage Uq whose period duration Tper multiplied by the resonant frequency fres of the load circuit produces approximately a natural number n which is greater than 1, and whose pulse duration Tpulse is in a range which is described by the following condition:

$$\frac{0.3}{fres} \leq Tpulse \leq \frac{1}{fres}$$

2. The appliance as claimed in claim 1, characterized in that the natural number n is equal to 3.

3. The appliance as claimed in claim 1, characterized in that the load circuit contains a series tuned circuit comprising an inductance (L) and a capacitance (C) connected in series.

4. The appliance as claimed in claim 1, characterized in that the AC voltage generator contains an independent oscillator (OSC).

5. The appliance as claimed in claim 4, characterized in that the independent oscillator (OSC) uses digital technology.

6. The appliance as claimed in claim 5, characterized in that the AC voltage generator contains electronic switches (S1, S2) which are driven by the signal which the independent oscillator (OSC) produces.

* * * * *